US005452955A

United States Patent [19]

Lundström

[11] Patent Number: 5,452,955

[45] Date of Patent: Sep. 26, 1995

[54] DEVICE FOR MIXING TWO FLUIDS HAVING DIFFERENT TEMPERATURES

[75] Inventor: Anders Lundström, Älvkarleby, Sweden

[73] Assignee: Vattenfall Utvecking AB, Alvkarleby, Sweden

[21] Appl. No.: 360,740

[22] Filed: Dec. 22, 1994

[30] Foreign Application Priority Data

Jun. 25, 1992 [SE] Sweden ..... 9201959

[51] Int. Cl.[6] ..... B01F 15/02

[52] U.S. Cl. ..... 366/163.2; 137/888; 366/336; 366/167.1

[58] Field of Search ..... 366/163.1, 163.2, 366/176.1, 173.1, 336, 337, 338, 340, 150.1; 137/888

[56] References Cited

U.S. PATENT DOCUMENTS

| | | | |
|---|---|---|---|
| 3,147,717 | 9/1964 | Smith | 366/336 |
| 4,159,881 | 7/1979 | Gogneau | 366/338 |
| 4,616,937 | 10/1986 | King | 366/336 |
| 4,721,126 | 1/1988 | Morii | 137/888 |
| 4,808,007 | 2/1989 | King | 366/336 |
| 4,917,151 | 4/1990 | Decker | 137/888 |

FOREIGN PATENT DOCUMENTS 62-27030 2/1987 Japan .

*Primary Examiner*—Robert W. Jenkins
*Attorney, Agent, or Firm*—Scully, Scott, Murphy & Presser

[57] ABSTRACT

Two fluids having different temperatures are to be mixed while supplying one fluid (A) through a main pipe (1) and conducting the other fluid (B) from a secondary pipe (2) into the main pipe. A mixing device (6) comprises a connecting branch which extends essentially radially into the main pipe (1) from the secondary pipe (2) and along whose outside the first fluid (A) may pass and which is formed with at least one nozzle-shaped aperture through which the second fluid (B) can be conducted into and mixed with the passing first fluid. The connecting branch comprises at least one through channel (13) extending transversely of the connecting branch and suitably in parallel with the longitudinal extent of the main pipe (1) and through which part of the first fluid can pass in a central partial flow. The inlet end of the channel (13) has a larger cross-sectional area than the outlet end, thereby giving the first fluid (A) an increased flow rate at the outlet end, the nozzle-shaped aperture being located adjacent this channel. In this manner, the second fluid is intimately mixed with the first in a centrally positioned area, while minimising every inclination of the second fluid to flow from the mixing device directly or abruptly, radially outwards towards the peripherally positioned main pipe (3).

20 Claims, 3 Drawing Sheets

DEVICE FOR MIXING TWO FLUIDS HAVING DIFFERENT TEMPERATURES

TECHNICAL FIELD OF THE INVENTION

The present invention relates to a device designed according to the preamble of claim 1 and intended for mixing two fluids, especially liquids, having different temperatures.

BACKGROUND OF THE INVENTION AND PRIOR-ART TECHNIQUE

In the systems of water pipes included in nuclear power plants and serving to conduct water to and from, inter alia, the reactor and the condenser, there are a plurality of points at which water having a certain temperature is to be mixed with water having a different temperature. This took previously place in simple T-piece connections or branch pipe points at which an open branch pipe opens directly into an aperture in the circumferential wall of a main pipe. At such branch points, the two water flows meet in an uncontrolled manner during rather intensive vorticity which, inter alia, implies that vortices or streaks of water having a certain, e.g. higher temperature than other streaks of water move back and forth both axially and sideways along the inside of the pipe wall of the main in the area downstream of the branch point. This means that at least the inside of the main pipe is subjected to intermittently repeated variations in temperature, leading to the pipe material, which in practice in most cases is acid-proof steel, alternately being subjected to compressive and tensile stress. This phenomenon, so-called thermal fatigue, shows itself in crack formations in the pipe material. If the differences in temperature between the two intermixed fluids are great, for example 50° C. or more, and the fatigue continues for a long time, the crack formation may advance so far as to jeopardise security. The inclination to form cracks will be especially pronounced in the area of welds which are frequently to be found in the vicinity of the branch point downstream thereof.

For the purpose of at least reducing the above-mentioned problems, attempts have recently been made to mount in the branch point between main and secondary pipes a special mixing device serving to control the mixing process in such a manner that the number of variations in temperature per unit of time along the internal surfaces of the pipe walls is reduced. For such mixing, use has been made of a connecting branch which extends essentially radially into the main pipe from the secondary pipe and in whose cylindrical circumferential surface there are formed a plurality of small perforations through which the water from the secondary pipe flows radially outwards in the form of a corresponding number of jets. In one embodiment, the connecting branch has been formed with perforations of the same size. In other embodiments, experiments have been made with apertures of different size. For example, the perforations of the connecting branch in the area of the main pipe centre have been made larger than the apertures closer to the peripheral wall of the pipe. These experiments have, however, not proved successful in so far as pronounced fluctuations in temperature along the pipe wall surfaces could not be prevented. Especially in variations of the water flows in the two pipes, the force of the jets through the perforations has increased and decreased and, since it was not be possible to prevent individual jets from hitting the inside of the main pipe, the jets will migrate along the surface of the pipe wall and cause variations in temperature in the pipe wall material.

OBJECTS AND FEATURES OF THE INVENTION

The present invention aims at eliminating the deficiencies of prior-art mixing devices of the type described above and providing a device which reduces the risk of thermal fatigue in the walls of the pipes and any welds therein to an absolute minimum. The main object of the invention thus is to provide a mixing device which is capable of mixing a fluid from a secondary pipe in a fluid passing through a main pipe, in an area which is centrally positioned in the main pipe and in such a manner that the mixing process is stable and uniform in the zone downstream of the mixing device, without any pronounced streaks or partial flows of only one fluid migrating back and forth along the inside of the main pipe. A further object of the invention is provide a mixing device which offers minimal resistance to the flow through the main pipe and which therefore causes but negligible pressure drops. In a particular aspect, the invention aims at providing a mixing device which is easy to mount at the branch points of existing systems of pipes, more precisely by being insertable in the secondary pipe after simple cutting off thereof, whereas the main pipe requires no changes.

According to the invention, at least the main object is achieved by means of the features defined in the characterising clause of claim 1. Preferred embodiments of the invention are stated in claims 2–7.

Further Elucidation of Prior Art

JP 62-27030 discloses a mixing device designed as an ejector and generally constructed as stated in the preamble of claim 1. Like the inventive device, this prior-art ejector device comprises a connecting branch which extends into a main pipe and which includes a central duct through which a first fluid may pass in a central partial flow, the duct being surrounded at its outlet end by an annular nozzle-shaped aperture through which a second fluid from a secondary pipe may pass into the main pipe. However, in this prior-art device, the duct is of the same cross-sectional area along its entire longitudinal extent, implying that no increase of the flow rate of the fluid passing through the duct from the inlet end towards the outlet end will take place. The central partial flow of the first fluid therefore exerts no entraining effect upon the second fluid. It should also be noted that the fluids that are intermixed in the device disclosed in JP 62-27030 are not characterised by having different temperatures, and that the object of the device is not at all to solve the crack formation problems which are caused by fluctuations in temperature in the pipe walls.

BRIEF DESCRIPTION OF THE ACCOMPANYING DRAWINGS

In the drawings,

FIG. 1 is a partial sectional view of two pipes meeting at a branch point at which a mixing device according to the invention is mounted, FIG. 2 is an enlarged vertical section of the mixing device according to FIG. 1, FIG. 3 is a horizontal cross-sectional view along the line III—III in FIG. 2, FIG. 4 is a side view as seen from the right in FIG. 2, FIG. 5 is a perspective view of the mixing device according to FIG. 2, FIG. 6 is a partial perspective view of parts of the interior of the mixing device, and FIG. 7 is a sectional view, corresponding to FIG. 2, of the fluid flows in the mixing device.

DETAILED DESCRIPTION OF A PREFERRED EMBODIMENT OF THE INVENTION

Figure 1:
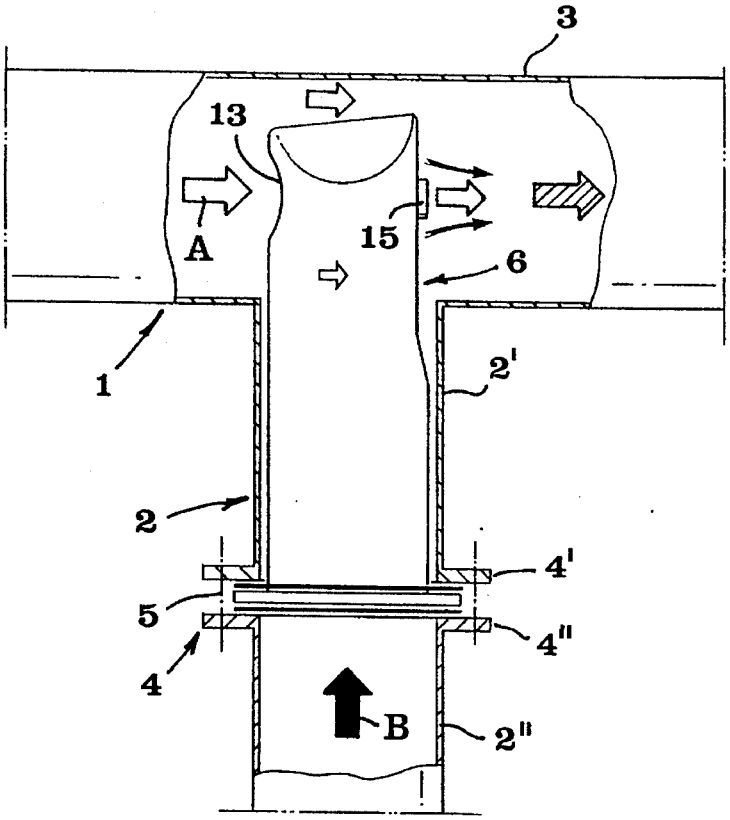
Figure 7:
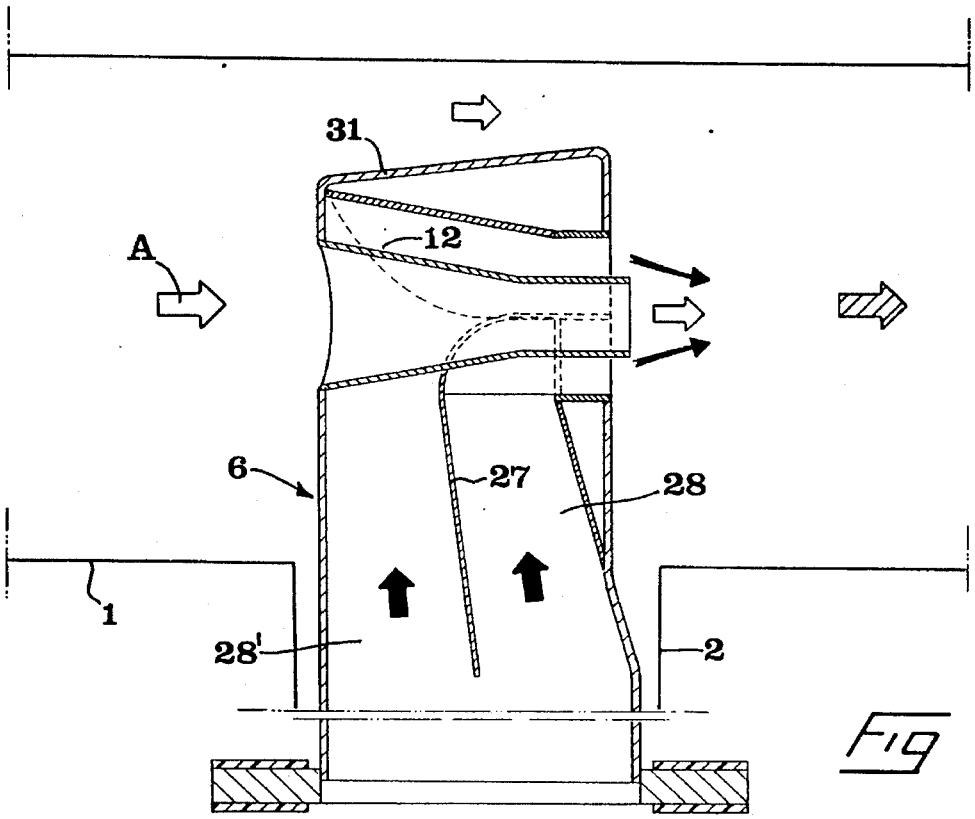

In FIG. 1, a first pipe or main pipe is generally designated 1, and a secondary pipe is generally designated 2. The actual pipe wall of the pipe 1, which in practice suitably is of cylindrical shape, is designated 3. The pipe 2 which advantageously extends perpendicularly away from the pipe 1, is in this case composed of two portions 2', 2", of which the first is permanently connected with the pipe 1 by being welded thereto, whereas the second portion 2" is releasably connected with the first portion 2' via a flange joint which in its entirety is designated 4. More specifically, the flange joint comprises a first flange 4' which is welded to the pipe portion 2', and a second flange 4" which is welded to end of the pipe portion 2". The two flanges 4' and 4" are held together by means of a suitable number of bolts 5 (not shown). In the thus formed T-joint or branch point, there is mounted a mixing device according to the invention, in its entirety designated 6.

In practice, a first fluid (indicated by arrow A) is supplied through the main pipe 1, while a second fluid (arrow B) is supplied through the secondary pipe 2 up to the branch point, to be mixed with the fluid A. The two fluids A, B, which in practice can be liquids, for example in the form of water, have different temperatures when reaching the branch point. When different water flows in a nuclear power plant are involved, the difference in temperature may amount to 50°–100° C., in some cases even more.

Reference is now made to FIGS. 2–7 which illustrate an embodiment of the mixing device 6, which in practice is preferred. The mixing device comprises as its main component a connecting branch 7 which has a closed end 8 and an open end 9. Preferably, although not necessarily, the basic shape of this connecting branch is cylindrical, with a diameter or width smaller than the inner diameter or width of the fixed pipe portion 2" of the secondary pipe 2. This applies to the entire length of the connecting branch, which means that it can be inserted in the pipe portion 2' to the position shown in FIG. 1. The connecting branch has at its open end a flange 10 which can be inserted between the flanges 4' and 4" to be clamped therebetween. Preferably, the flange 10 is fitted with elastic seals 11, 11' made of e.g. heat resistant rubber or like material.

Adjacent to the closed end 8 of the connecting branch 7 there is arranged a through duct which in its entirety is designated 12 and which defines a channel 13 extending transversely of the connecting branch, suitably in parallel with the longitudinal extent of the main pipe 1, through which channel 13 part of the first fluid A can pass in a partial flow which is central or spaced from the pipe wall 3. The duct 12 has an inlet end 14 which opens into a portion of the circumferential wall of the connecting branch, upstream in the main pipe 1, and an outlet end 15 which is positioned in an aperture 16 formed in a diametrically opposite, downstream portion 7' of the pipe wall. As is evident from FIG. 4, the aperture 16 is of a greater diameter or width than the outlet end of the duct 12, thereby forming between the outside of the duct and the edge 17 of the wall portion 7', which defines the aperture 16, an annular gap which serves as a nozzle-shaped aperture for discharging the second fluid B into the main pipe 1. The inlet end 14 of the transverse duct is of a larger cross-sectional area than the outlet end 15, the duct becoming narrower from the inlet end towards the outlet end, thereby giving the fluid entering the duct an increased speed at the outlet end. In the embodiment illustrated, the duct 12 is composed of a conical or conically truncated tube portion 18 widening towards the inlet end 14, and a cylindrical tube portion 19 connecting with the outlet end 15. The cross-sectional area adjacent the inlet opening 14 should be 2–8 times larger than the cross-sectional area adjacent the outlet opening 15. In practice, the diameter of the tube portion 19 may amount to about 20 mm, whereas the diameter of the wide inlet end of the conical tube portion 18 amounts to about 40 mm (the area of the inlet opening being four times larger than that of the outlet opening). If the duct 12 has the dimensions stated above, the connecting branch 7 suitably has a diameter of 80–100 mm, and the main pipe 1 a diameter in the range of 130–170 mm, for instance 150 mm.

Figure 2:
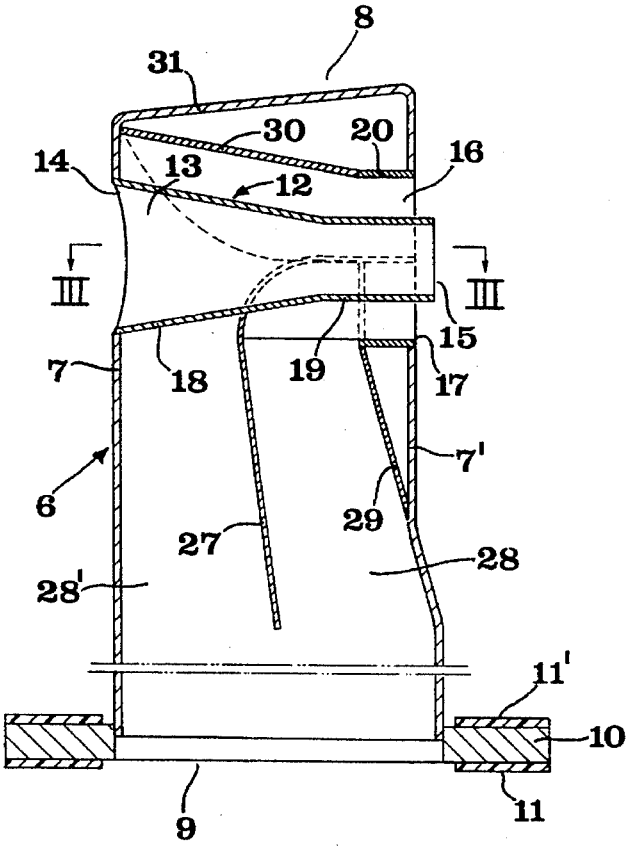
Figure 4:
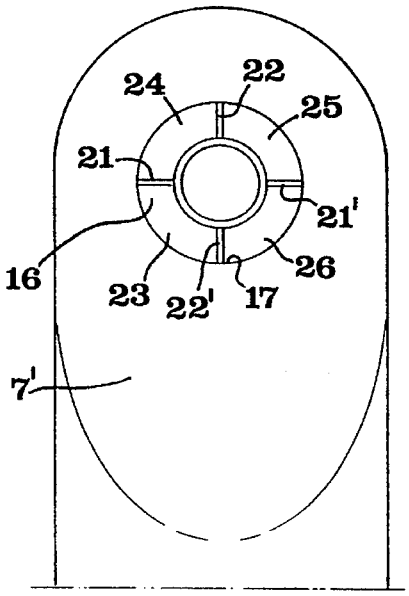
Figure 3:
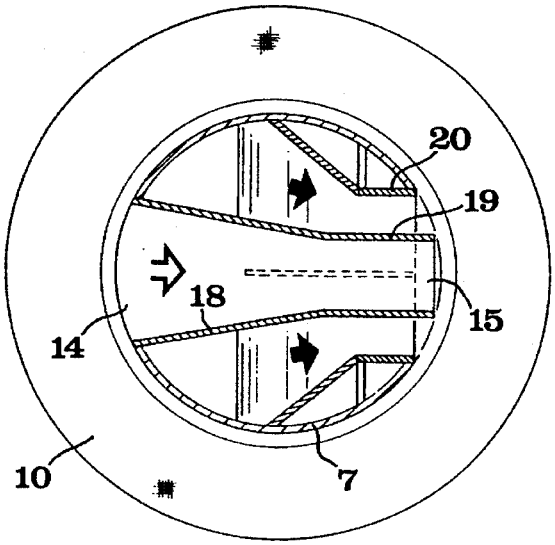
Figure 5:
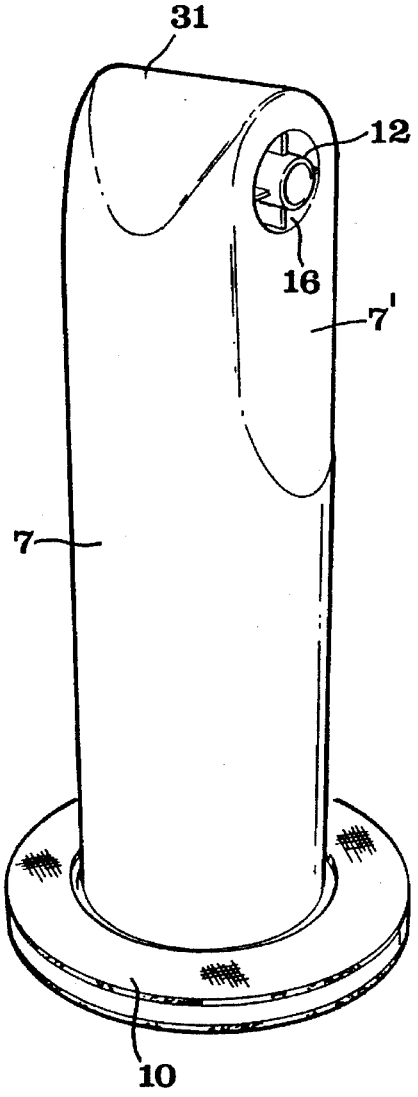
Figure 6:
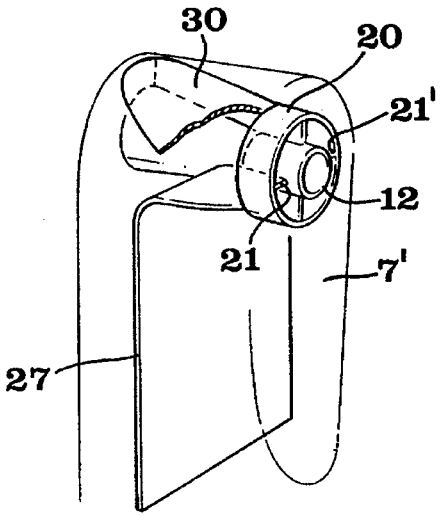

As is evident especially from FIGS. 4–6, the wall portion 7', in which the aperture 16 is formed, is flat and passes into the otherwise essentially cylindrical circumferential wall of the connecting branch 7 via softly rounded wall portions. This flat wall portion 7' extends in practice in a plane perpendicular to the longitudinal axis of the main pipe 1. FIGS. 2 and 6 illustrate how an annular collar 20 extends a distance into the interior of the connecting branch from the edge 17. In the aperture or annular gap 16 there are arranged a number of, in this case four, wings 21, 21', 22, 22' which extend radially from the duct 12 and which sector wise separate partial apertures 23, 24, 25, 26 for a corresponding number of partial flows through the annular gap. The two diametrically opposite and in this case horizontal wings 21 and 21' pass into a substantially L-shaped guide plate 27 (see FIG. 2) which divides the interior of the connecting branch into two separate flow paths 28, 28' having essentially equally large flow areas, thereby forming two equally great partial flows on opposite sides of the wings 21, 21'. The guide plate or partition 27 is, as appears from FIG. 2, slightly inclined relative to the centre axis of the connecting branch 7 in order to compensate for the space inside the connecting branch, which is taken up by a guide plate 29 connected to the inner end of the collar 20 and serving to guide the arriving fluid B to the inner mouth of the collar without any inconvenient turbulence or vorticity. By inclining the partition 27 in the manner illustrated, it is ensured that the two flow paths 28, 28' obtain essentially equally large flow areas in optional cross-sections along the longitudinal axis of the connecting branch. In connection with the upper side of the duct 12, there is arranged a third guide plate or wall 30 of arched cross-section, serving to deflect and guide the fluid entering along the flow path 28', to the two upper partial apertures 24, 25 above the wings 21, 21'. The two vertical wings 22 and 22' serve to stabilise the two partial flows which are discharged via the upper and lower halves of the annular gap 16, while the horizontal wings 21, 21' separate these two flows.

As shown in FIG. 1, the channel 13 is located in the area of the centre axis of the main pipe 1, substantially in parallel therewith. During operation, the part of the fluid A which passes through the channel 13 in the duct 12 will be compressed and leave the outlet end 15 of the duct in the form of a joined jet in the centre of the pipe 1, at a comparatively high speed. At the same time, the fluid B is discharged from the secondary pipe 2 via the annular gap 16, see FIG. 7, in an annular flow which surrounds this central jet and which, in practice, should have a lower speed than the central jet. In this manner, the faster moving central jet entrains the slower, surrounding annular flow of the fluid B, rather than the annular flow B tending to move radially towards the pipe wall 3. The mixing of the two fluids will therefore take place in a central area downstream of the mixing device. Although this central area widens as the distance from the mixing device increases, the flow will be homogeneous and stable in so far as individual jets or streaks of only one medium will not move back and forth in certain points or spots along the inside of the pipe wall 3. Even if the temperature in the pipe wall may vary according to the varying temperature and flow quantities of the fluids in the pipes 1, 2, the changes in temperature thus occur in a comparatively slow and stable manner, without causing intermittent, quick changes from point to point along the inside of the pipe wall, thereby preventing thermal fatigue in the pipe wall material.

At its closed, free end 8, the connecting branch 7 is formed with a wall portion 31 which is arcuate in cross-section and has a straight back inclined relative to the centre axis of the main pipe 1, more precisely in such a manner that the upstream end of the back is positioned at a greater radial distance from the pipe wall 3 of the main pipe than its downstream end. Since the space between the pipe wall 3 and this inclined wall portion 31 successively tapers in the downstream direction, the passing fluid is given an increasing speed and then forms, immediately inside the pipe wall 3, a distinct flow which counteracts every inclination of the fluids in the central mixing zone in the area downstream of the annular gap 16 to flow out-wards into direct contact with the pipe wall in the immediate vicinity of the mixing device.

Since the connecting branch 7 along its entire length is of a smaller diameter than the pipe portion 2', it may be readily mounted not only in systems of pipes which are being mounted, but also in existing systems of pipes. In the latter case, the secondary pipe 2 can be easily cut off at a suitable distance from the main pipe and be fitted with the flanges 4', 4" in the cutting-off position, whereupon the flange 10 at the open end of the connecting branch is clamped between these flanges by means of the tightenable bolts 5.

POSSIBLE MODIFICATION OF THE INVENTION

Of course, the invention is not restricted merely to the embodiment described above and shown in the drawings. Thus, it is possible to design the individual mixing device with two or more transverse ducts instead of one, thereby establishing more partial flows. Although in that case, the ducts will not be positioned exactly along the centre axis of the main pipe, they will, however, still be pronouncedly spaced from the inside of the main pipe wall. Although the different pipes included in the device are shown to be of cylindrical basic shape, or a basic shape which is circular in cross-section, the invention does not exclude the possibility of using pipes of other cross-sectional shapes. Especially the connecting branch 7 can be designed to have a different cross-section, for example oval. It should also be noted that the outer contour of the end of the connecting branch 7, which extends into the main pipe, may be varied. Thus, this end can be designed as a head which is round in cross-section and has a truncated conical shape whose narrow end is positioned upstream, whereby the head—by analogy with the inclined back 31, although along its entire circumference—gives the passing fluid an increasing speed in the downstream direction along the main pipe.

We claim:

1. In a device for mixing two fluids having different temperatures, said device including a connecting branch extending essentially radially into a primary pipe having a longitudinal axis and through which a first fluid is supplied from a secondary pipe through which a second fluid is supplied, said first fluid passing along the outside of said connecting branch, said connecting branch having at least one nozzle-shaped aperture through which said second fluid can be conducted and mixed with said fluid, said connecting branch having at least one channel, said channel having an inlet and an outlet, said channel extending transversely of said connecting branch and parallel relative to said longitudinal axis of said primary pipe and through which part of said first fluid may flow in a central partial flow spaced from a wall of said primary pipe, and said nozzle-shaped apertures being positioned adjacent and surrounding said channel, thereby providing mixing of the second fluid in the first fluid in an area which is centrally positioned or spaced from said wall of said primary pipe, the improvement wherein from a cross-sectional area of said inlet of said channel is about 2 to about 8 times larger than a cross sectional area that of said outlet, said channel decreasing in cross-sectional area from said inlet end to said outlet for increasing the speed of said first fluid at said outlet such that said first fluid entrains the surrounding flow of said second fluid through said nozzle-shaped apertures, whereby radial outward flow of said second fluid from said device is substantially reduced.

2. The device as claimed in claim 1, wherein said channel is defined by a duct, said duct having an inlet end opening into an upstream side of a circumferential wall of said connecting branch, and an outlet end disposed in an aperture formed in an downstream wall portion, said aperture having a greater diameter than said outlet end of said duct thereby forming, an annular gap which serves as a nozzle-shaped aperture for discharging said second fluid in said primary pipe.

3. The device as claimed in claim 2, wherein said duct comprise a conical tube portion widening towards said inlet end and a cylindrical tube portion connected to said outlet end.

4. The device as claimed in claim 3, wherein said nozzle-shaped aperture includes a plurality of wings, said wings projecting radially from said duct and dividing said nozzle-shaped aperture into a plurality of separate partial apertures for providing a corresponding number of partial flow areas through said nozzle-shaped aperture, at least two of said wings being diametrically opposed and passing into a substantially L-shaped guide plate, said plate dividing the interior of said connecting branch into two separate flow paths thereby forming two equally large partial flows on opposite sides of said two wings.

5. The device as claimed in claim 3, wherein a free end of said connecting branch includes a closed arc-shaped wall portion having a straight portion which is inclined relative to the centre axis of the primary pipe, such that the upstream end of said back is positioned at a greater radial distance from the pipe wall of said primary pipe than the downstream end thereof.

6. The device as claimed in claim 3, wherein said connecting branch has a smaller diameter, than said secondary pipe or the mouth thereof in said primary pipe, whereby said connecting branch can be mounted in an existing primary pipe.

7. The device as claimed in claim 2, wherein said nozzle-shaped aperture includes a plurality of wings, said wings projecting radially from said duct and dividing said nozzle-shaped aperture into a plurality of separate partial apertures for providing a corresponding number of partial flow areas through said nozzle-shaped aperture, at least two of said wings being diametrically opposed and passing into a substantially L-shaped guide plate, said plate dividing the interior of said connecting branch into two separate flow paths thereby forming two equally large partial flows on opposite sides of said two wings.

8. The device as claimed in claim 2, wherein a free end of said connecting branch includes a closed arc-shaped wall portion having a straight portion which is inclined relative to the centre axis of the primary pipe, such that the upstream end of said back is positioned at a greater radial distance from the pipe wall of said primary pipe than the downstream end thereof.

9. The device as claimed in claim 2, wherein said connecting branch has a smaller diameter, than said secondary pipe or the mouth thereof in said primary pipe, whereby said connecting branch can be mounted in an existing primary pipe.

10. The device as claimed in claim 1, wherein said nozzle-shaped aperture is formed in said downstream portion, said wall extending perpendicularly relative to said longitudinal axis of said primary pipe and passing into said cylindrical circumferential wall of said connecting branch via softly rounded wall portions.

11. The device as claimed in claim 10, wherein said nozzle-shaped aperture is formed in said downstream portion, said wall extending perpendicularly relative to said longitudinal axis of said primary pipe and passing into said cylindrical circumferential wall of said connecting branch via softly rounded wall portions.

12. The device as claimed in claim 11, wherein said nozzle-shaped aperture includes a plurality of wings, said wings projecting radially from said duct and dividing said nozzle-shaped shaped aperture into a plurality of separate partial apertures for providing a corresponding number of partial flow areas through said nozzle-shaped aperture, at least two of said wings being diametrically opposed and passing into a substantially L-shaped guide plate, said plate dividing the interior of said connecting branch into two separate flow paths thereby forming two equally large partial flows on opposite sides of said two wings.

13. The device as claimed in claim 11, wherein a free end of said connecting branch includes a closed arc-shaped wall portion having a straight portion which is inclined relative to the centre axis of the primary pipe, such that the upstream end of said back is positioned at a greater radial distance from the pipe wall of said primary pipe than the downstream end thereof.

14. The device as claimed in claim 10, wherein said nozzle-shaped aperture includes a plurality of wings, said wings projecting radially from said duct and dividing said nozzle-shaped aperture into a plurality of separate partial apertures for providing a corresponding number of partial flow areas through said nozzle-shaped aperture, at least two of said wings being diametrically opposed and passing into a substantially L-shaped guide plate, said plate dividing the interior of said connecting branch into two separate flow paths thereby forming two equally large partial flows on opposite sides of said two wings.

15. The device as claimed in claim 10, wherein a free end of said connecting branch includes a closed arc-shaped wall portion having a straight portion which is inclined relative to the centre axis of the primary pipe, such that the upstream end of said back is positioned at a greater radial distance from the pipe wall of said primary pipe than the downstream end thereof.

16. The device as claimed in claim 10, wherein said connecting branch has a smaller diameter, than said secondary pipe or the mouth thereof in said primary pipe, whereby said connection branch can be mounted in an existing primary pipe.

17. The device as claimed in claim 1, wherein said nozzle-shaped aperture includes a plurality of wings, said wings projecting radially from said duct and dividing said nozzle-shaped aperture into a plurality of separate partial apertures for providing a corresponding number of partial flow areas through said nozzle-shaped aperture, at least two of said wings being diametrically opposed and passing into a substantially L-shaped guide plate, said plate dividing the interior of said connecting branch into two separate flow paths thereby forming two equally large partial flows on opposite sides of said two wings.

18. The device as claimed in claim 17, wherein said inlet of said connecting branch includes a flange and seal means adapted for connection with pipe portions associated with said secondary pipe.

19. The device as claimed in claim 1, wherein a free end of said connecting branch includes a closed arc-shaped wall portion having a straight portion which is inclined relative to the centre axis of the primary pipe, such that the upstream end of said back is positioned at a greater radial distance from the pipe wall of said primary pipe than the downstream end thereof.

20. The device as claimed in claim 1, wherein said connecting branch has a smaller diameter, than said secondary pipe or the mouth thereof in said primary pipe, whereby said connecting branch can be mounted in an existing primary pipe.

* * * * *

UNITED STATES PATENT AND TRADEMARK OFFICE

CERTIFICATE OF CORRECTION

PATENT NO. : 5,452,955

DATED : September 26, 1995

INVENTOR(S) : Rolf Karlsson, et al.

It is certified that error appears in the above-indentified patent and that said Letters Patent is hereby corrected as shown below:

Column 2, line 63: "FIG. 2,FIG." should read --FIG. 2,--

Column 2, line 64: before "5" insert --FIG.--

Column 7, line 34, Claim 12: delete second occurrence of --shaped--

Signed and Sealed this

Twenty-fifth Day of June, 1996

Bruce Lehman

*Attest:*

BRUCE LEHMAN

*Attesting Officer*

*Commissioner of Patents and Trademarks*